US011802457B1

(12) United States Patent
Wai

(10) Patent No.: US 11,802,457 B1
(45) Date of Patent: Oct. 31, 2023

(54) CUTTING TOOL WITH SPIRAL CUTOUTS FOR METAL CUTTINGS REMOVAL

(71) Applicant: Halliburton Energy Services, Inc., Houston, TX (US)

(72) Inventor: Simon Whye Kwong Wai, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/663,041

(22) Filed: May 12, 2022

(51) Int. Cl.
*E21B 29/00* (2006.01)

(52) U.S. Cl.
CPC ..... *E21B 29/002* (2013.01)

(58) Field of Classification Search
CPC ..... E21B 29/00; E21B 29/002; E21B 29/005; E21B 31/16; E21B 31/20
See application file for complete search history.

(56) References Cited

U.S. PATENT DOCUMENTS 2,246,418 A * 6/1941 Froome ..... E21B 17/22 175/218
2,708,104 A * 5/1955 McAllister ..... E21B 25/12 175/255
3,283,405 A * 11/1966 Braswell ..... E21B 29/005 30/103
4,484,642 A * 11/1984 Evans ..... E21B 17/22 175/323
8,020,639 B2 9/2011 Wells et al.
2002/0112894 A1* 8/2002 Caraway ..... E21B 10/26 175/391
2002/0162659 A1* 11/2002 Davis ..... E21B 29/005 166/361
2008/0236828 A1* 10/2008 Fuhst ..... E21B 29/005 166/55.6
2011/0308813 A1 12/2011 Barron et al.
2014/0138083 A1 5/2014 Fanini et al.
2014/0138091 A1* 5/2014 Fuhst ..... E21B 29/005 166/55.7
2015/0060040 A1 3/2015 Ruttley
2016/0251924 A1* 9/2016 Porter ..... E21B 29/002 166/55.7
2016/0251925 A1* 9/2016 Porter ..... E21B 29/002 166/55.7
2020/0232295 A1* 7/2020 Telfer ..... E21B 17/07
2020/0362655 A1* 11/2020 McGarian ..... E21B 29/06

FOREIGN PATENT DOCUMENTS

WO 9937881 A2 7/1999
WO 2018182899 A1 10/2018

* cited by examiner

*Primary Examiner* — David Carroll
(74) *Attorney, Agent, or Firm* — Sheri Higgins Law, PLLC; Sheri Higgins

(57) ABSTRACT

A cutting tool can be used to cut through a tubing string in a wellbore. Metal cuttings are formed during the cutting process. The cutting tool can include a cutting insert with a blade that is rotated around a longitudinal axis of the tool. A nose can include a spiral cutout adjacent to the blade. The spiral cutout can force the metal cuttings down past the outside of the nose and down into the tubing string. The nose can also include a guide on the outside underneath the blade. The guide can also provide a pathway for the metal cuttings to fall past the outside of the nose and down into the tubing string. The spiral cutout and the optional guide can be used to prevent metal cuttings from lodging within the cutting tool and preventing the tool from rotating and cutting.

20 Claims, 7 Drawing Sheets

CUTTING TOOL WITH SPIRAL CUTOUTS FOR METAL CUTTINGS REMOVAL

TECHNICAL FIELD

A cutting tool can be used to cut through a tubing string in a wellbore. Metal cuttings can be formed during the cutting process. The cutting tool can include spiral cutouts that remove the metal cuttings from the tool. A guide can also be included that aids in guiding the metal cuttings downhole past the tool.

BRIEF DESCRIPTION OF THE FIGURES

The features and advantages of the various embodiments will be more readily appreciated when considered in conjunction with the accompanying figures. The figures are not to be construed as limiting any of the embodiments.

DETAILED DESCRIPTION

Figure 1A:
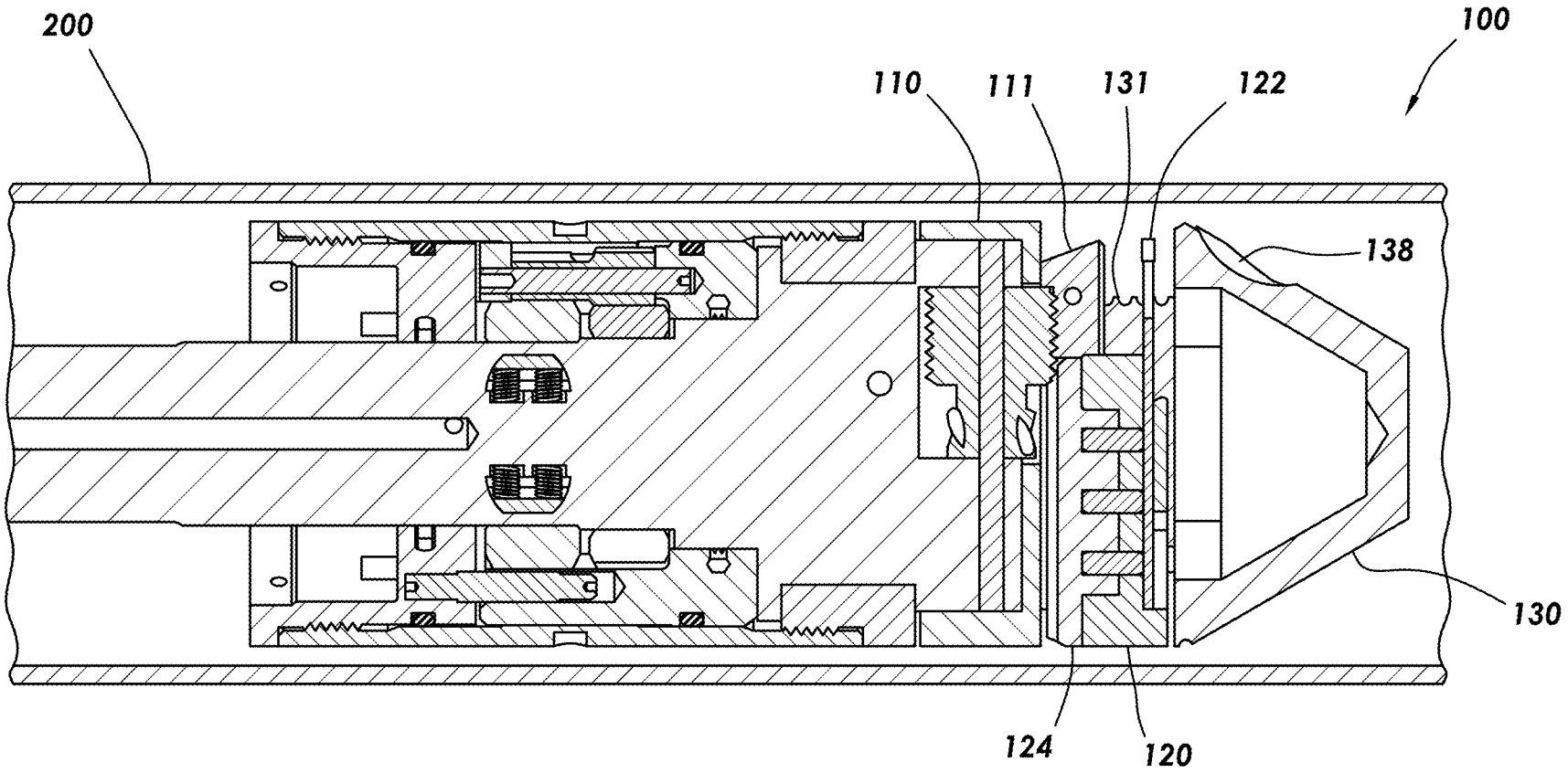
FIG. 1A is a cross-sectional view of a cutting tool prior to cutting through a tubing string according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. As used herein, "into a wellbore" means and includes into any portion of the well.

A tubing string or casing string (collectively called "tubing string") can be used in wellbore operations. The tubing string can be used to run in downhole tools, introduce fluids into the wellbore, and produce formation fluids from the subterranean formation. There are some situations where a tubing string located within a wellbore needs to be cut. By way of example, a downhole tool or component can become stuck within the tubing string. By way of another example, during well abandonment operations, sections of a tubing string can be cut so the cut section falls to the bottom of the wellbore so cement can be placed in the wellbore.

A cutting tool can be used to cut through the tubing string. Cutting tools can be installed within the tubing string and a cutting blade is rotated around an axis of the tool. The blade cuts through the tubing string. However, during the cutting process, a large volume of metal cuttings is formed as the blade cuts deeper into the tubing string. The metal cuttings can become lodged or jammed within the cutting tool adjacent to the cutting blade. When the metal cuttings jam up within the cutting tool, the cutting operation cannot continue, and the cutting tool must be removed from the tubing string and the cuttings must be removed from the tool before the tool can be re-installed within the tubing string to complete the cut.

In order to prevent jamming, metal cuttings breakers, also referred to as a chip breaker, can be used to assist in the curling up and breaking of the chips into smaller and more manageable sizes. However, the formation of long, continuous metal cuttings when cutting ductile materials have led to tool jams during cutting even with the use of chip breakers. Buildup of the metal cuttings near the cutting blade can lead to practical problems such as stalling of the cutter insert during rotation and obstruction which does not allow the cutting blade to fully retract. The inability to retract the blade, as well as the large volume of metal chips jammed near the cutter insert can lead to over-pulls when the tool is being pulled out of the tubing string—essentially the cutting blade is lodged within the tubing string and more force is required to remove the cutting tool from the tubing string to clear the jam. Over-pulls can lead to irreversible damage to both the cutting tool and the tubing string. Thus, there is a long-felt need for a cutting tool whereby the metal cuttings do not build upon each other and jam the cutting tool.

It has been discovered that a cutting tool can include spiral cutouts located on a nose of the cutting tool adjacent to a cutting insert of the tool. The spiral cutouts can direct the formed metal cuttings away from the cutting insert, past the nose, and down into the tubing string. The nose can also include a guide that also assists in directing the metal cuttings away from the cutting insert and down into the tubing string. It is to be understood that the use of the words "top," "bottom," "up," and "down" are for orientation purposes and do not mean vertical orientations only as horizontal wellbores do not have a vertical orientation. Accordingly, top and up mean at a location closer to a wellhead, and bottom and down mean at a location farther away from the wellhead.

According to any of the embodiments, a cutting tool for cutting a tubing string in a wellbore comprises a cutting insert; a blade located at an end of the cutting insert; and a nose comprising a spiral cutout located adjacent to the cutting insert.

According to any of the embodiments, a method of cutting through a tubing string within a wellbore comprises introducing the cutting tool into the wellbore; rotating the cutting insert and the nose around a longitudinal axis of the cutting tool; and allowing the blade to cut through the tubing string.

The various disclosed embodiments apply to the systems, methods, and apparatuses without the need to repeat the various embodiments throughout.

Figure 1B:
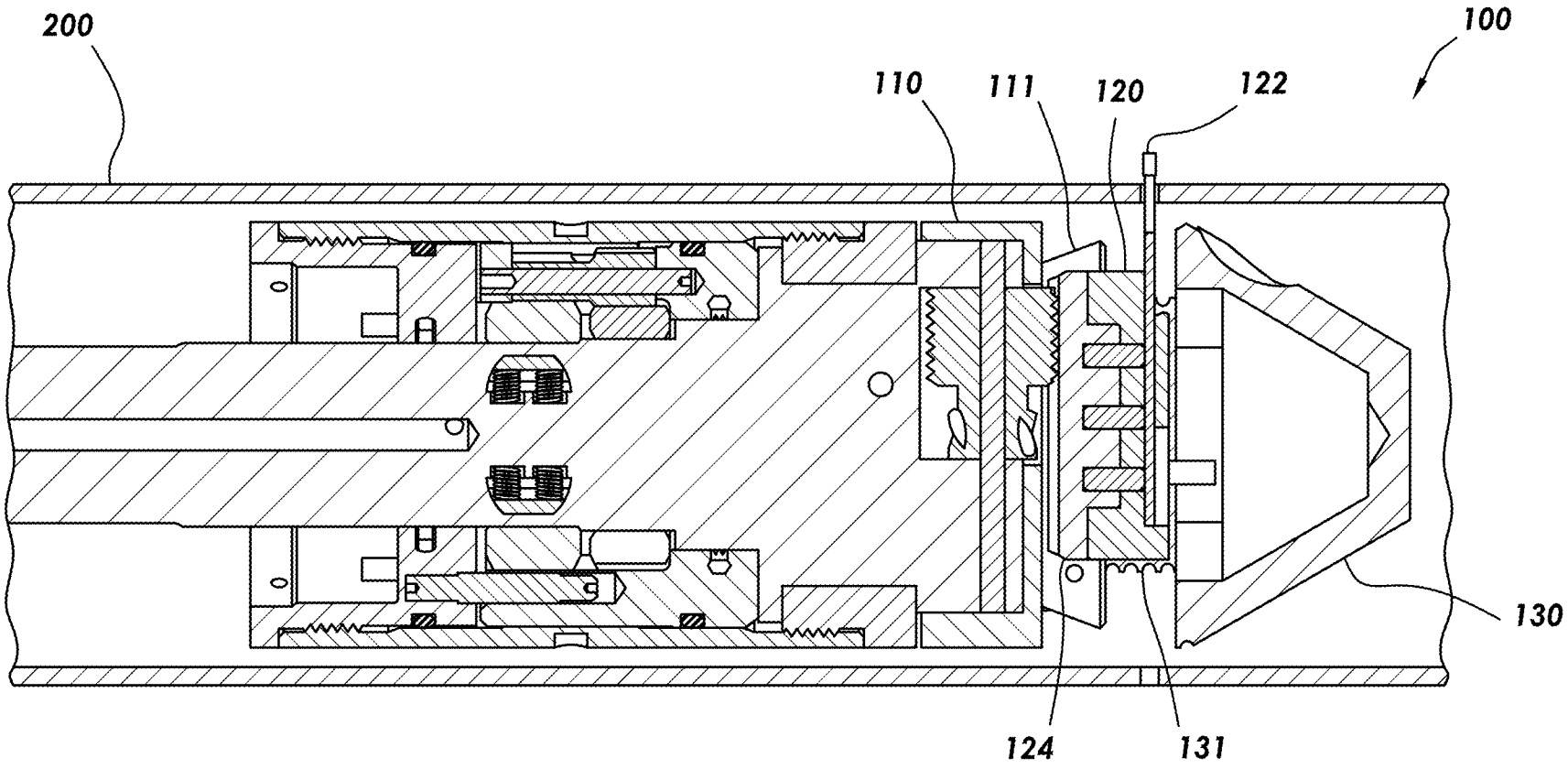
FIG. 1B is a cross-sectional view of the cutting tool of FIG. 1A after cutting through the tubing string.

Turning to the Figures, FIGS. 1A and 1B are cross-sectional views of a cutting tool 100. The cutting tool 100 can be installed within a tubing string 200. The cutting tool 100 includes a body and a longitudinal axis 101 (shown in FIG. 2). The cutting tool 100 includes an interface sub-assembly 110. The cutting tool 100 also includes a slide sub-assembly 120 that is slidably connected to the interface sub-assembly 110. The slide sub-assembly 120 includes a cutting insert 122. The cutting tool 100 also includes a nose 130.

The interface sub-assembly 110, slide sub-assembly 120, cutting insert 122, and nose 130 are rotated around the longitudinal axis 101 of the cutting tool 100. The rotation can be clockwise or counterclockwise around the longitudinal axis 101 of the cutting tool 100. As shown in FIG. 1A, the cutting insert 122 is in a retracted position and a blade 123 is not in contact with an inner diameter of the tubing string 200. As the components of the cutting tool 100 are rotated, the cutting insert 122 can protract, come in contact with the inner diameter of the tubing string 200, and begin cutting through the tubing string. The cutting insert 122 can continue to protract with each revolution of the cutting insert 122 until the tubing string has been cut through. The number of revolutions and length of time to cut through the tubing string 200 can vary, in part depending on the thickness of the tubing string as defined as the difference between an outer diameter and inner diameter of the tubing string. By way of example, it may take up to 2 minutes to cut through a ¼ inch thick tubing string. As shown in FIG. 1B, the cutting insert 122 is in a fully protracted position and has cut through the tubing string 200.

Figure 3:
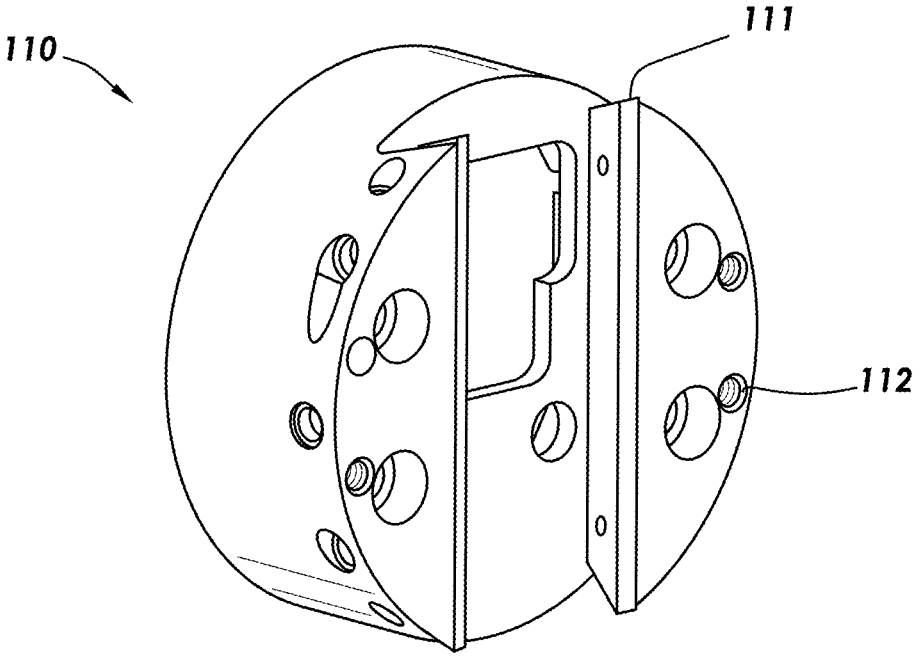
FIG. 3 is a bottom perspective view of an interface sub-assembly according to certain embodiments.
Figure 4:
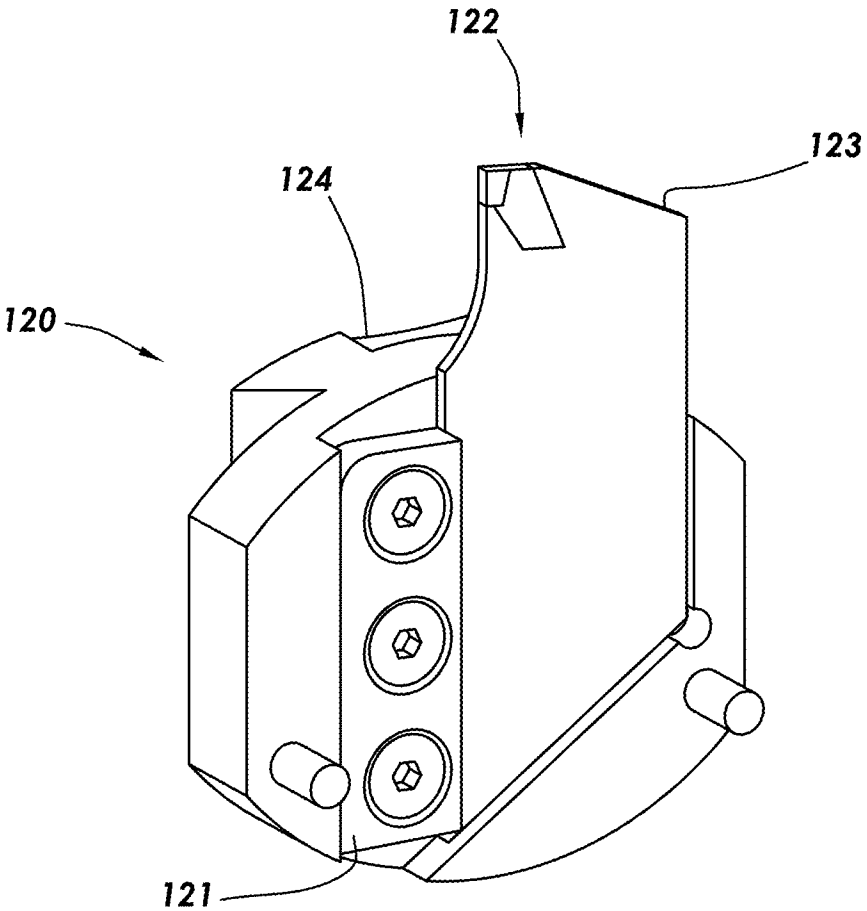
FIG. 4 is a bottom perspective view of a slide sub-assembly according to certain embodiments.

As shown in FIG. 3, the interface sub-assembly 110 can include tracks 111 and threaded holes 112. As shown in FIG. 4, the slide sub-assembly 120 can include a slider rack 124. The slider rack 124 of the slide sub-assembly 120 fits within and is slidably connected to the interface sub-assembly 110 via the tracks 111. As the cutting tool 100 is rotated about the longitudinal axis 101, the slide sub-assembly 120 slides within the interface sub-assembly 110 along the tracks 111 to convert the cutting insert 122 from a retracted position to a protracted position, for example as shown in FIG. 1B.

With continued reference to FIG. 4, the slide sub-assembly 120 can also include a blade grip 121 that houses the blade 123 of the cutting insert 122 within the slide sub-assembly 120. The blade 123 can be angled and can cut through the tubing string 200 during rotation of the cutting tool 100 and protraction of the cutting insert 122. Protraction of the cutting insert 122 occurs via sliding movement of the slide sub-assembly 120 within the tracks 111 of the interface sub-assembly 110.

Figure 5:
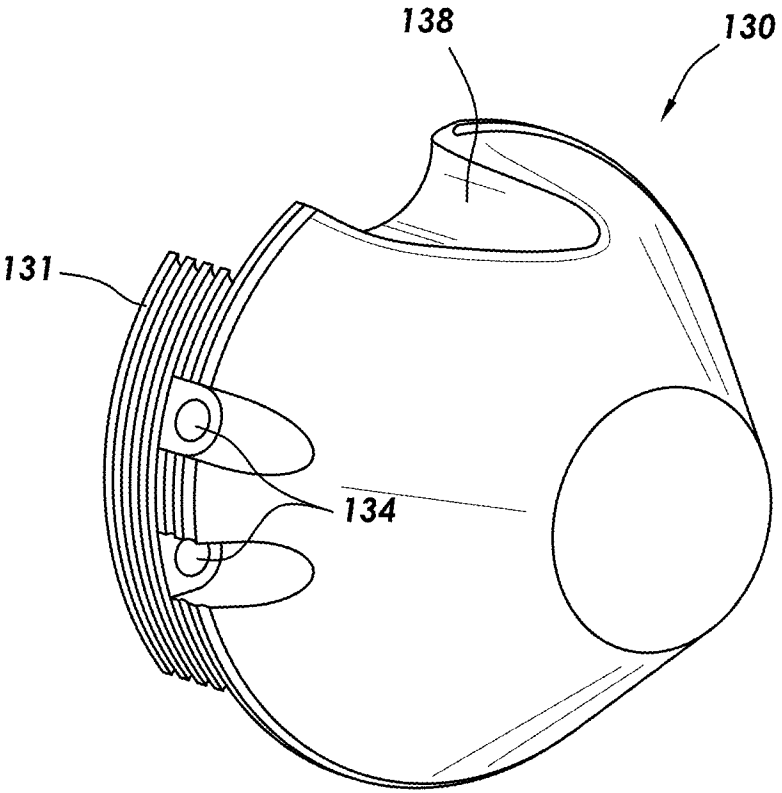
FIG. 5 is a bottom perspective view of a nose showing the spiral cutouts and guide according to certain embodiments.
Figure 6:
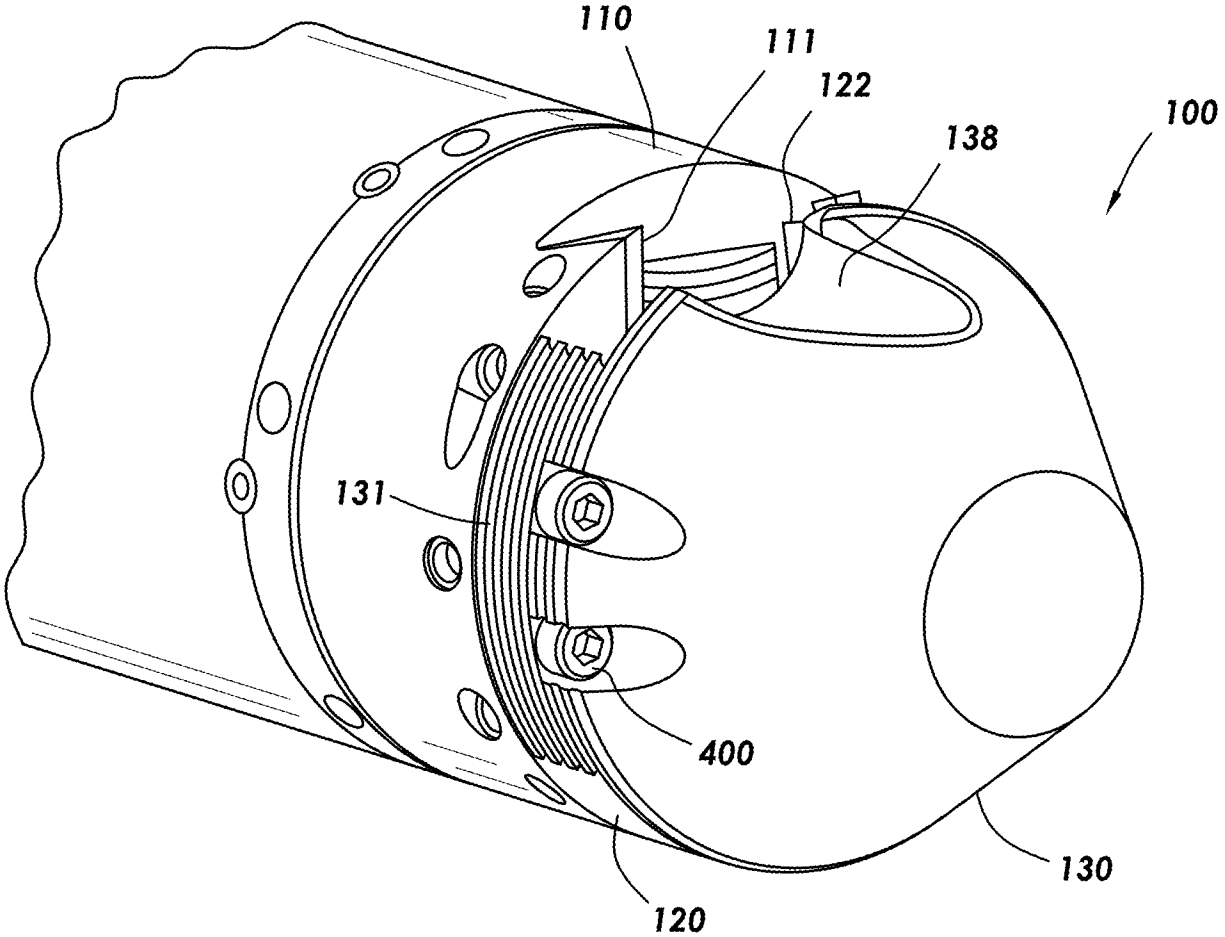
FIG. 6 is a bottom, side perspective view of the cutting tool according to certain embodiments.

FIG. 5 is a front perspective view of the nose 130. As can be seen, the nose 130 can include threaded holes 134. The nose 130 can be removably attached to the interface sub-assembly 110 by threading nose screws 400 through the threaded holes 134 of the nose 130 and the threaded holes 112 of the interface sub-assembly 110, for example as shown in FIG. 6.

Figure 2:
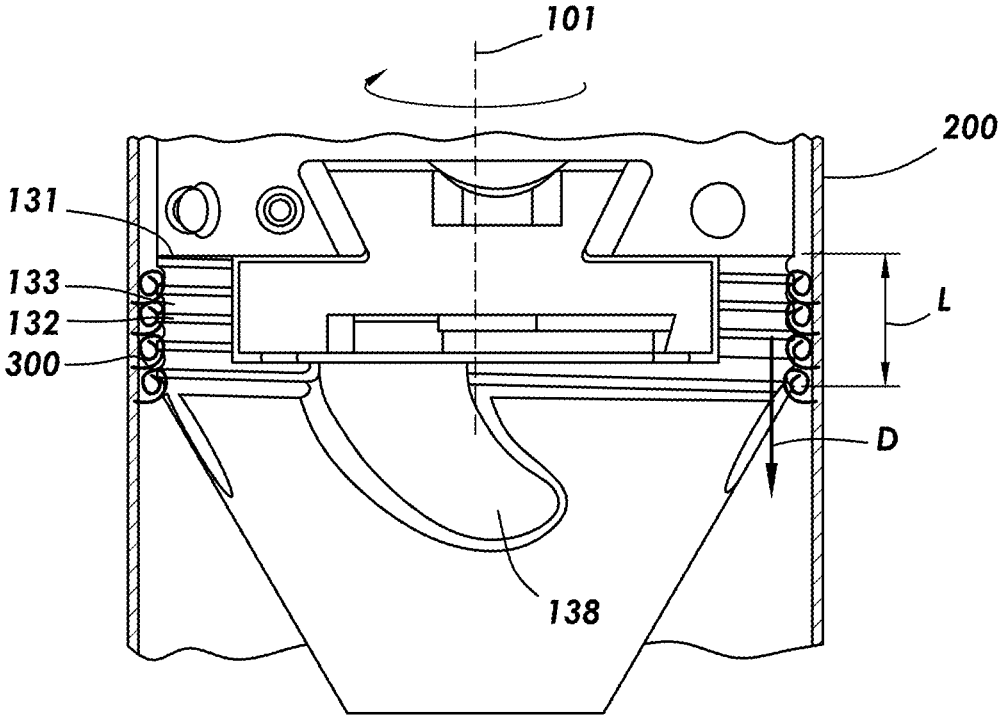
FIG. 2 is front perspective view of the cutting tool showing the spiral cutouts and guide according to certain embodiments.

With reference to FIG. 2, the nose 130 includes a spiral cutout 131 located adjacent to the cutting insert 122. The spiral cutout 131 can resemble threads of a screw. The spiral cutout 131 can have a length L. The length L of the spiral cutout 131 can be selected based on the anticipated volume of metal cuttings to be produced and can range from ½ inch to 1.5 inches. The spiral cutout 131 includes a plurality of crests 132 and roots 133. The crests 132 can be in-line with the outer diameter of a portion of the nose 130 and a portion of the interface sub-assembly 110. The pitch is defined as the distance between two crests 132. The pitch can range from 0.1 to 0.5 inch. The depth of thread of the spiral cutout 131 as defined as the distance between the crests 132 and the roots 133 can range from 0.02 to 0.05 inch.

With reference to FIG. 2, the spiral cutout 131 can form a right-hand spiral or a left-hand spiral. According to any of the embodiments, the spiral cutout 131 has an opposite spiral from the direction of rotation of the cutting tool 100. By way of a first example, if the cutting tool 100 rotates in a clockwise direction about the longitudinal axis 101 as viewed from the top of the cutting tool 100 as shown in FIG. 2, then the spiral cutout 131 has a left-hand spiral. By way of a second example, if the cutting tool 100 rotates in a counterclockwise direction about the longitudinal axis 101, then the spiral cutout 131 has a right-hand spiral. In this manner, the spiral cutout 131 can force the metal cuttings 300 around the outside of the nose 130 in a direction D away from the cutting insert 122 and down into the tubing string.

The length L of the spiral cutout 131, the number of crests 132, the pitch, depth of the thread, and the type of spiral can each be selected such that the metal cuttings 300 are forced past the nose 130 and down into the tubing string. By way of example, for a tubing string made of a ductile material, such as stainless steel, alloy steel, carbon steel, or superalloys, which is likely to produce long, continuous metal cuttings 300, then the depth of the thread can be increased in order to accommodate the larger metal cuttings produced without jamming.

As shown in FIGS. 2, 5, and 6, the cutting tool 100 can also include a guide 138. The guide 138 can be a recessed portion on the nose 130 located underneath the blade 123 of the cutting insert 122. The guide 138 can have a recessed depth that is greater at a first end directly underneath the blade 123, wherein the depth of the recess becomes less at a second end farther away from the blade 123. In other words, the depth of the recess of the guide 138 can taper from the first end to being flush with the outside of the nose 130 at the second end. As can also be seen, for example, in FIG. 2, the guide 138 can curve from the first end to the second end. The guide 138 can curve to the left or the right when viewing the nose 130 from the front (shown in FIG. 2 with the guide 138 curving to the right). The curve direction can be selected based on the direction of rotation of the cutting tool 100. By way of example, if the cutting tool 100 rotates in a clockwise direction about the longitudinal axis 101, then the guide 138 can curve to the right as shown in FIG. 2 and vice versa. The guide 138 can assist the metal cuttings 300 that are formed adjacent to the blade 123 during cutting to fall into the guide 138. As the nose 130 rotates with the cutting insert 122, the metal cuttings 300 can follow the curvature of the guide 138 and flow past the outside of the nose 130 and down into the tubing string 200.

The dimensions of the guide 138 can vary and can be selected based in part on the anticipated size and/or volume of metal cuttings 300 that are to be produced during cutting. By way of example, the width of the first end of the recessed portion can range from 0.5 to 1.5 inches. Additionally, the length of the guide 138 from the first end to the second end can range from 1 to 3 inches. In this manner, the guide 138 can be used in conjunction with the spiral cutout 131 to remove the metal cuttings 300 from the areas around the cutting insert 122 and nose 130.

The components of the cutting tool 100, for example, the interface sub-assembly 110, the slide sub-assembly 120, the cutting insert 122, and the nose 130 can be made from a variety of materials used for cutting tools to cut through a tubing string.

Figure 7A:
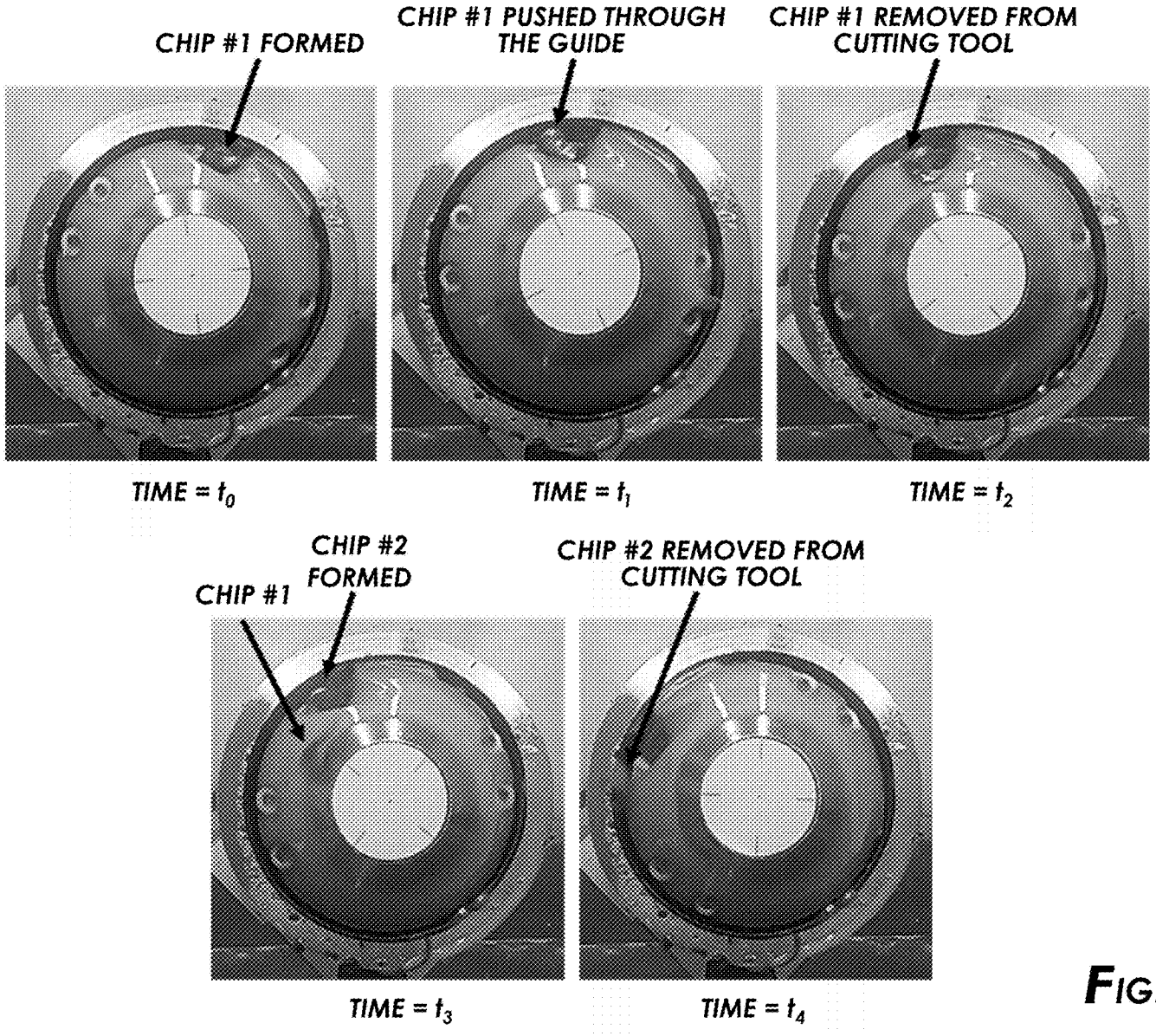
FIGS. 7A and 7B are photographs showing the cutting tool removing metal cuttings according to certain embodiments.
Figure 7B:
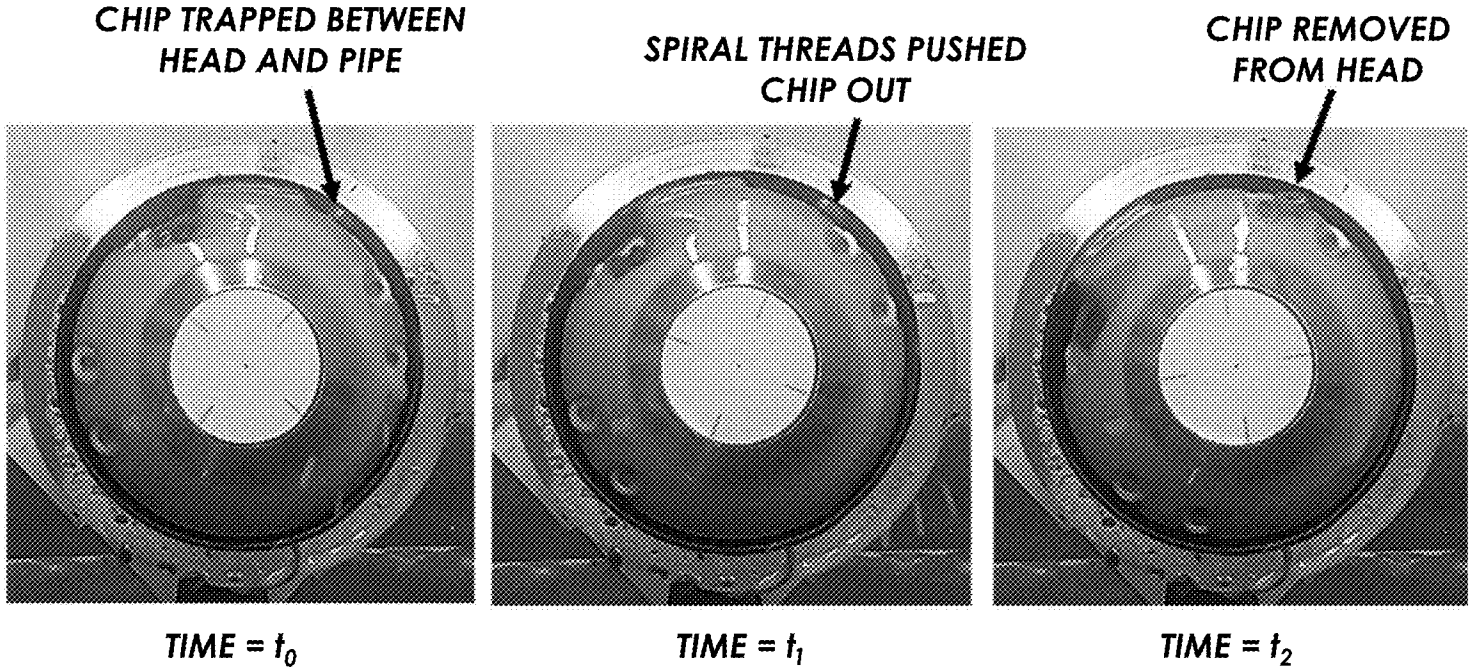

FIGS. 7A and 7B are photographs of the cutting tool 100 used to remove metal cuttings. The cutting tool 100 was rotated clockwise about a longitudinal axis when viewed from the top of the tool, for example as shown in FIG. 2. The photographs show the tool when viewed facing the bottom of the tool and nose; thus, the rotation is counterclockwise about the axis in these views. As can be seen in FIG. 7A, a first chip or metal cutting is formed as the tool begins to rotate and cut into the tubing string. As the tool continues to rotate, the first chip is pushed through the guide at time $t_1$ and completely removed from the tool at $t_2$. A second chip is formed at time $t_3$ and removed from the tool at $t_4$. As can be seen in FIG. 7B, a chip or metal cutting is formed as the tool begins to rotate and cut into the tubing string and becomes trapped between the top of the nose and the inside of the tubing string. As the tool continues to rotate, the chip is pushed through the guide by the spiral cutouts at time $t_1$ and completely removed from the tool at $t_2$. Accordingly, the spiral cutout 131 and the optional guide 138 are highly effective at removing metal cuttings from the tool and preventing the metal cuttings from becoming lodged around the outside of the cutting insert 122 and inside of the tubing string, which could jam the cutting tool and possibly prevent retraction of the cutting insert 122.

The methods include introducing the cutting tool 100 within the tubing string 200. The tubing string 200 can be located within a wellbore of a well. The well can be, without limitation, an oil, gas, or water production well, an injection well, or a geothermal well. The well can also be an offshore well. The methods can include rotating the cutting insert 122 and the nose 130 around a longitudinal axis 101 of the cutting tool 100. As the components are rotated, the blade 123 of the cutting insert 122 can cut into the inside of the tubing string 200. The methods can include allowing the blade to cut through the tubing string. The step of allowing can include continued rotation of the cutting insert and the nose for a desired amount of time. The desired amount of time can be a time greater than or equal to the anticipated time needed to cut entirely through the tubing string, for example, based on the thickness of the tubing string and the material making up the tubing string to be cut. The methods can also include retracting the cutting insert after the tubing string has been cut through. The methods can also include removing the cutting tool from the tubing string after the tubing string has been cut through and the cutting insert has been retracted.

An embodiment of the present disclosure is a cutting tool for cutting a tubing string in a wellbore comprising: a cutting insert; a blade located at an end of the cutting insert; and a nose comprising a spiral cutout located adjacent to the cutting insert. Optionally, the cutting tool further comprises a body, an interface sub-assembly, a slide sub-assembly, and a longitudinal axis. Optionally, the cutting tool further comprises wherein the interface sub-assembly, the slide sub-assembly, the cutting insert, and the nose are rotated around the longitudinal axis. Optionally, the cutting tool further comprises wherein the spiral cutout has a length ranging from 0.5 inch to 1.5 inches. Optionally, the cutting tool further comprises wherein the spiral cutout comprises a plurality of crests and roots. Optionally, the cutting tool further comprises wherein the spiral cutout has a pitch ranging from 0.1 to 0.5 inch. Optionally, the cutting tool further comprises wherein a depth of thread of the spiral cutout ranges from 0.02 to 0.05 inch. Optionally, the cutting tool further comprises wherein the spiral cutout forms a right-hand spiral or a left-hand spiral. Optionally, the cutting tool further comprises wherein the nose and the cutting insert are configured to rotate in a clockwise direction about a longitudinal axis of the cutting tool as viewed from the top of the cutting tool, and wherein the spiral cutout has a left-hand spiral. Optionally, the cutting tool further comprises wherein the nose and the cutting insert are configured to rotate in a counterclockwise direction about a longitudinal axis of the cutting tool as viewed from the top of the cutting tool, and wherein the spiral cutout has a right-hand spiral. Optionally, the cutting tool further comprises a guide, wherein the guide is a recessed portion on the nose that is located underneath the blade. Optionally, the cutting tool further comprises wherein the guide comprises a first end that is located directly underneath the blade and a second end that is located opposite from the first end, and wherein the guide has a recessed depth that is greater at a first end than the second end. Optionally, the cutting tool further comprises wherein the guide curves from the first end to the second end. Optionally, the cutting tool further comprises wherein the nose and the cutting insert are configured to rotate in a clockwise direction about a longitudinal axis of the cutting tool as viewed from the top of the cutting tool, and wherein the guide curves to the left from the first end to the second end as viewed from the top of the cutting tool. Optionally, the cutting tool further comprises wherein the nose and the cutting insert are configured to rotate in a counterclockwise direction about a longitudinal axis of the cutting tool as viewed from the top of the cutting tool, and wherein the guide curves to the right from the first end to the second end as viewed from the top of the cutting tool. Optionally, the cutting tool further comprises wherein a width of the first end ranges from 0.5 to 1.5 inches. Optionally, the cutting tool further comprises wherein a length of the guide from the first end to the second end ranges from 1 to 3 inches.

Another embodiment of the present disclosure is a method of cutting through a tubing string within a wellbore comprising: introducing a cutting tool into the wellbore, wherein the cutting tool comprises: a cutting insert; a blade located at an end of the cutting insert; and a nose comprising a spiral cutout located adjacent to the cutting insert; rotating the cutting insert and the nose around a longitudinal axis of the cutting tool; and allowing the blade to cut through the tubing string. Optionally, the method further comprises a body, an interface sub-assembly, a slide sub-assembly, and a longitudinal axis. Optionally, the method further comprises wherein the interface sub-assembly, the slide sub-assembly, the cutting insert, and the nose are rotated around the longitudinal axis. Optionally, the method further comprises wherein the spiral cutout has a length ranging from 0.5 inch to 1.5 inches. Optionally, the method further comprises wherein the spiral cutout comprises a plurality of crests and roots. Optionally, the method further comprises wherein the spiral cutout has a pitch ranging from 0.1 to 0.5 inch. Optionally, the method further comprises wherein a depth of thread of the spiral cutout ranges from 0.02 to 0.05 inch. Optionally, the method further comprises wherein the spiral cutout forms a right-hand spiral or a left-hand spiral. Optionally, the method further comprises wherein the nose and the cutting insert are configured to rotate in a clockwise direction about a longitudinal axis of the cutting tool as viewed from the top of the cutting tool, and wherein the spiral cutout has a left-hand spiral. Optionally, the method further comprises wherein the nose and the cutting insert are configured to rotate in a counterclockwise direction about a longitudinal axis of the cutting tool as viewed from the top of the cutting tool, and wherein the spiral cutout has a right-hand spiral. Optionally, the method further comprises a guide, wherein the guide is a recessed portion on the nose that is located underneath the blade. Optionally, the method further comprises wherein the guide comprises a first end that is located directly underneath the blade and a second end that is located opposite from the first end, and wherein the guide has a recessed depth that is greater at a first end than the second end. Optionally, the method further comprises wherein the guide curves from the first end to the second end. Optionally, the method further comprises wherein the nose and the cutting insert are configured to rotate in a clockwise direction about a longitudinal axis of the cutting tool as viewed from the top of the cutting tool, and wherein the guide curves to the left from the first end to the second end as viewed from the top of the cutting tool. Optionally, the method further comprises wherein the nose and the cutting insert are configured to rotate in a counterclockwise direction about a longitudinal axis of the cutting tool as viewed from the top of the cutting tool, and wherein the guide curves to the right from the first end to the second end as viewed from the top of the cutting tool. Optionally, the method further comprises wherein a width of the first end ranges from 0.5 to 1.5 inches. Optionally, the method further comprises wherein a length of the guide from the first end to the second end ranges from 1 to 3 inches.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more ends, metal cuttings, etc., as the case may be, and do not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A cutting tool for cutting a tubing string in a wellbore comprising:

a cutting insert;

a blade located at an end of the cutting insert; and a nose comprising a spiral cutout, wherein the spiral cutout is in a plane with the cutting insert, and wherein the plane is parallel to the cutting insert.

2. The cutting tool according to claim 1, further comprising an interface sub-assembly, a slide sub-assembly, and a longitudinal axis.

3. The cutting tool according to claim 2, wherein the interface sub-assembly, the slide sub-assembly, the cutting insert, and the nose are configured to rotate around the longitudinal axis.

4. The cutting tool according to claim 1, wherein the spiral cutout has a length ranging from 0.5 inch to 1.5 inches.

5. The cutting tool according to claim 1, wherein the spiral cutout comprises a plurality of crests and roots.

6. The cutting tool according to claim 1, wherein the spiral cutout has a pitch ranging from 0.1 to 0.5 inch.

7. The cutting tool according to claim 1, wherein a depth of thread of the spiral cutout ranges from 0.02 to 0.05 inch.

8. The cutting tool according to claim 1, wherein the nose and the cutting insert are configured to rotate in a clockwise direction about a longitudinal axis of the cutting tool as viewed from the top of the cutting tool, and wherein the spiral cutout has a left-hand spiral.

9. The cutting tool according to claim 1, wherein the nose and the cutting insert are configured to rotate in a counterclockwise direction about a longitudinal axis of the cutting tool as viewed from the top of the cutting tool, and wherein the spiral cutout has a right-hand spiral.

10. The cutting tool according to claim 1, further comprising a guide, wherein the guide is a recessed portion on the nose that is located underneath the blade.

11. The cutting tool according to claim 10, wherein the guide comprises a first end that is located directly underneath the blade and a second end that is located opposite from the first end, and wherein the guide has a recessed depth that is greater at a first end than the second end.

12. The cutting tool according to claim 11, wherein the guide curves from the first end to the second end.

13. The cutting tool according to claim 12, wherein the nose and the cutting insert are configured to rotate in a clockwise direction about a longitudinal axis of the cutting tool as viewed from the top of the cutting tool, and wherein the guide curves to the left from the first end to the second end as viewed from the top of the cutting tool.

14. The cutting tool according to claim 12, wherein the nose and the cutting insert are configured to rotate in a counterclockwise direction about a longitudinal axis of the cutting tool as viewed from the top of the cutting tool, and wherein the guide curves to the right from the first end to the second end as viewed from the top of the cutting tool.

15. The cutting tool according to claim 11, wherein a width of the first end ranges from 0.5 to 1.5 inches.

16. The cutting tool according to claim 11, wherein a length of the guide from the first end to the second end ranges from 1 to 3 inches.

17. A method of cutting through a tubing string within a wellbore comprising:

introducing a cutting tool into the wellbore, wherein the cutting tool comprises:

a cutting insert;

a blade located at an end of the cutting insert; and a nose comprising a spiral cutout wherein the spiral cutout is in a plane with the cutting insert, and wherein the plane is parallel to the cutting insert; rotating the cutting insert and the nose around a longitudinal axis of the cutting tool; and allowing the blade to cut through the tubing string.

18. The method according to claim 17, wherein the nose and the cutting insert rotate in a clockwise direction about the longitudinal axis and the spiral cutout has a left-hand spiral, or wherein the nose and the cutting insert rotate in a counterclockwise direction about the longitudinal axis and the spiral cutout has a right-hand spiral.

19. The method according to claim 17, wherein the cutting tool further comprises a guide, and wherein the guide is a recessed portion on the nose that is located underneath the blade.

20. The method according to claim 19, wherein the guide comprises a first end that is located directly underneath the blade and a second end that is located opposite from the first end, and wherein the guide has a recessed depth that is greater at a first end than the second end.

* * * * *